US007444962B2

(12) United States Patent
Engelin et al.

(10) Patent No.: US 7,444,962 B2
(45) Date of Patent: Nov. 4, 2008

(54) COOLANT CIRCUIT FOR A COOLANT-COOLED INTERNAL COMBUSTION ENGINE

(75) Inventors: Werner Engelin, Esslingen (DE); Hartmut Engels, Wolfschlugen (DE); Erhard Rau, Weilheim (DE); Jochen Weeber, Filderstadt (DE); Frank Weinert, Wimsheim (DE)

(73) Assignee: Daimler AG, Stuttgart (DE)

( * ) Notice: Subject to any disclaimer, the term of this patent is extended or adjusted under 35 U.S.C. 154(b) by 276 days.

(21) Appl. No.: 11/519,453

(22) Filed: Sep. 12, 2006

(65) Prior Publication Data

US 2007/0062466 A1 Mar. 22, 2007

Related U.S. Application Data

(63) Continuation-in-part of application No. PCT/EP2005/002421, filed on Mar. 8, 2005.

(30) Foreign Application Priority Data

Mar. 13, 2004 (DE) ..... 10 2004 012 372

(51) Int. Cl.
*F01P 7/14* (2006.01)

(52) U.S. Cl. ..... 123/41.1; 123/41.29

(58) Field of Classification Search ..... 123/41.12, 123/41.1, 41.2, 41.29
See application file for complete search history.

(56) References Cited

U.S. PATENT DOCUMENTS 4,325,219 A * 4/1982 Stang et al. ..... 60/599
4,550,694 A * 11/1985 Evans ..... 123/41.02
4,616,484 A * 10/1986 Mehdi et al. ..... 62/180
4,930,455 A * 6/1990 Creed et al. ..... 123/41.1
4,972,808 A 11/1990 Hashimoto
4,976,462 A 12/1990 Hirata et al.
5,408,957 A * 4/1995 Crowley ..... 123/27 GE
5,497,734 A 3/1996 Okada
5,549,832 A * 8/1996 Ische et al. ..... 210/694
5,888,385 A * 3/1999 Ische et al. ..... 210/167.31

(Continued)

FOREIGN PATENT DOCUMENTS

DE 1 916 640 10/1970

(Continued)

*Primary Examiner*—Noah Kamen
(74) *Attorney, Agent, or Firm*—Klaus J. Bach

(57) ABSTRACT

In a coolant circuit for an internal combustion engine having two cylinder banks, a radiator for cooling the engine coolant, a pump and a thermostatic valve including a mixing chamber and first and second flow control valves, wherein the pump is connected to the radiator via an intake line for receiving coolant therefrom and supplying it to the cylinder banks which are in communication with the mixing chamber from which a radiator line extends to the radiator for returning heated coolant to the radiator under the control of a flow control valve, or supplying it via a bypass line to the intake line under the control of a bypass valve, a heating circuit is provided extending from one of the cylinder banks via a heater to the pump intake line and a heater control valve is disposed in the heating control circuit so that, upon opening of the heater valve, coolant flows from the other cylinder bank via the mixing chamber to the one cylinder bank and coolant from both cylinder banks jointly flows through the heating circuit back to the pump.

2 Claims, 1 Drawing Sheet

U.S. PATENT DOCUMENTS

| | | | | |
|---|---|---|---|---|
| 6,460,492 | B1 | 10/2002 | Black et al. | |
| 6,843,210 | B2 * | 1/2005 | Engelin | 123/41.1 |
| 6,981,850 | B1 * | 1/2006 | Maltbie et al. | 417/201 |
| 2001/0042525 | A1 * | 11/2001 | Lehmann | 123/41.1 |
| 2003/0230443 | A1 * | 12/2003 | Cramer et al. | 180/65.5 |
| 2004/0107922 | A1 * | 6/2004 | Roth | 123/41.1 |

FOREIGN PATENT DOCUMENTS

| | | |
|---|---|---|
| DE | 2 206 266 | 8/1973 |
| DE | 2 320 447 | 11/1974 |
| DE | 195 23 610 | 1/1997 |
| DE | 197 25 222 | 12/1998 |
| DE | 100 48 792 | 5/2002 |
| DE | 100 61 546 | 8/2002 |
| DE | 102 06 359 | 9/2003 |
| EP | 1 258 608 | 11/2002 |

* cited by examiner

COOLANT CIRCUIT FOR A COOLANT-COOLED INTERNAL COMBUSTION ENGINE

This is a Continuation-In-Part Application of pending International patent Application PCT/EP2005/002421 filed Mar. 8, 2005 and claiming the priority of German patent Application 01 2004 012 372.1 filed Mar. 13, 2004.

BACKGROUND OF THE INVENTION

The invention relates to a coolant circuit for an internal combustion engine, including a liquid coolant with a coolant radiator having a radiator line and a bypass line, by way of which coolant can by-pass the radiator. The coolant flow through the bypass line is controllable as a function of temperature via a thermostatic valve which has a flow connection to the radiator line, a connection to the bypass line, a further connection to a supply line or removal line on the internal combustion engine, and a connection to a connecting line which leads from a mixing chamber to a heating circuit and is intended for generating a temperature control flow on the expansion element. The heating circuit has a heating valve for controlling the coolant flow in the heating circuit, and the thermostatic valve has a thermostatic operating element which is arranged in the mixing chamber and is provided with a main valve disk controlling the flow connection to the radiator line with a short-circuit valve disk controlling the flow connection to the bypass line.

DE 102 06 359 A1 discloses such a coolant circuit with a thermostatic valve arranged on the motor outlet side. The thermostatic valve has an expansion element which is connected to a main valve disk and a short-circuit valve disk (two-disk thermostatic valve) in such a manner that, after a cold start, the main and short-circuit valves are initially closed by the main and short-circuit valve disks, so that the coolant circuit is interrupted (full throttling of the coolant circuit). With increasing heating of the internal combustion engine, first of all the short-circuit valve for a coolant circuit between internal combustion engine and by-pass line is opened and, with further heating of the internal combustion engine, the main valve is subsequently opened and the short-circuit valve closed again.

So that, when the coolant circuit is interrupted, the coolant which is warming up can nevertheless reach the expansion element in a controlled manner, a temperature control line leading into the heating circuit is attached to the mixing chamber. This temperature control line can be used to generate, in a controlled manner, a small coolant flow in the mixing chamber, causing the expansion element to initiate further control movements.

DE 197 25 222 A1 discloses a thermostatic valve with an expansion element for controlling a main and a short-circuit valve. The short-circuit valve has a short-circuit valve disk which is held on the expansion element in a manner such that it can be displaced relative thereto and which is biased in the closing direction by a spring. During a cold start, both the main valve and the short-circuit valve are closed, so that the coolant circuit is blocked. The spring loading the short-circuit valve disk is configured in such a manner that it keeps the short-circuit valve closed up to a predetermined partial-load rotational speed of rotation of the internal combustion engine and only then, as a result of a rise in pressure in the coolant circuit, is the short-circuit valve disk displaced in the opening direction against the force of the spring.

Disadvantages of a thermostatic valve of this type are its complicated structural design and the only relatively small degree of accuracy obtainable for the opening and closing times for the valve disks.

It is therefore the object of the present invention to provide an improved coolant circuit for internal combustion engines with a plurality of cylinder banks, which is simplified in its design and control and by which the engine warm-up period is shortened.

SUMMARY OF THE INVENTION

In a coolant circuit for an internal combustion engine having two cylinder banks, a radiator for cooling the engine coolant, a pump and a thermostatic valve including a mixing chamber and first and second flow control valves, wherein the pump is connected to the radiator via an intake line for receiving coolant therefrom and supplying it to the cylinder banks which are in communication with the mixing chamber from which a radiator line extends to the radiator for returning heated coolant to the radiator under the control of a flow control valve, or supplying it via a bypass line to the intake line under the control of a bypass valve, a heating circuit is provided extending from one of the cylinder banks via a heater to the pump intake line and a heater control valve is disposed in the heating control circuit so that, upon opening of the heater valve, coolant flows from the other cylinder bank via the mixing chamber to the one cylinder bank and coolant from both cylinder banks jointly flows through the heating circuit back to the pump.

The connection of the heating circuit to the thermostatic valve makes it possible in an advantageous manner to control the temperature of the expansion element via the heating circuit. In particular with a cyclically operated valve provided in the heating circuit, the control of the temperature of the expansion element can take place in accordance with predetermined parameters, as a result of which the warm-up period can be reduced. In addition, the use of the heating circuit to control the temperature of the expansion element has the advantage that a particular temperature control line can be omitted, which leads to a simplification of the coolant circuit.

The invention will become more readily apparent from the following description of exemplary embodiments on the basis of the accompanying drawings;

DESCRIPTION OF AN EXEMPLARY EMBODIMENT

Figure 1:
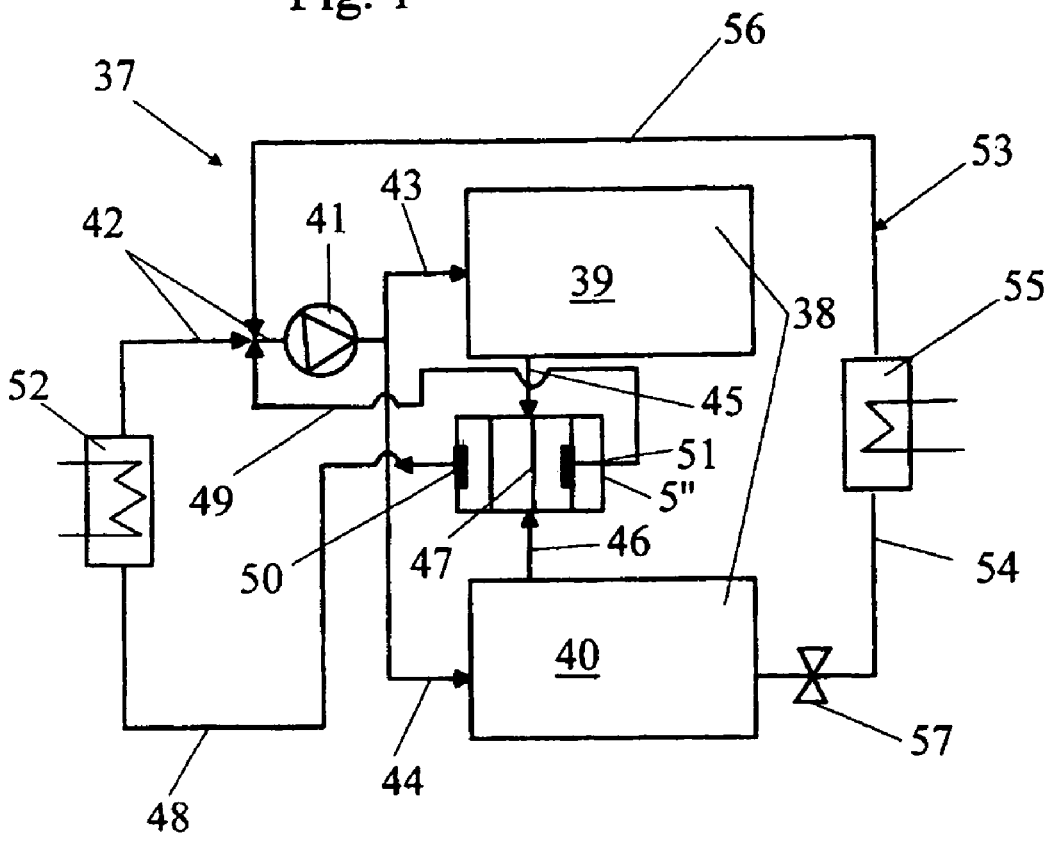
FIG. 1 shows a diagrammatically illustrated coolant circuit for an internal combustion engine with two cylinder banks.

In the exemplary embodiment of FIG. 1, a coolant circuit 37 for an internal combustion engine 38 with two cylinder banks 39 and 40 is illustrated. The cooling spaces of the two cylinder banks 39 and 40 are fed separately with coolant by a coolant pump 41 in a common supply line 42 with line strands 43 and 44 branching off to the two cylinder banks 39, 40. From the cooling spaces, the coolant is conveyed further through separate return lines 45, 46 into a mixing chamber 47 of a thermostatic valve 5". The mixing chamber 47 has a communication opening to a radiator line 48 and a bypass opening arranged in the thermostat housing opposite the communication opening and leading to a bypass line 49. In this case, the communication opening to the radiator line 48 is controlled by a main valve disk 50 and the bypass opening is controlled by a bypass valve disk 51. While the radiator line 48 is connected to a radiator 52 whose discharge is connected to the supply line 42, the by-pass line 49 connects the bypass opening of the thermostatic valve 5" directly to the supply line 42 at a location upstream of the coolant pump 41.

In addition to the coolant circuit 37, a heating circuit 53 is provided which is connected to the cooling space of the cylinder bank 40 by a heater supply line 54 which leads to a heating heat exchanger 55 which is likewise connected on the exit side by a return line 56 to the supply line 42 upstream of the coolant pump 41. By means of a heating valve 57 in the heater supply line 54, the coolant flow in the heating circuit can be controlled for heating purposes, with the heating valve 57 preferably being designed as an electrically or electronically controllable cyclically operated valve.

In the cold state of the internal combustion engine 38, the attachment opening for the radiator line 48 in the thermostatic valve 5" is closed by the main valve disk 50 and the bypass opening for the bypass line 49 is closed by the bypass valve disk 51. The coolant pressure therefore prevails everywhere within the coolant circuit 37. For lack of a suitable pressure drop, no coolant flow can form in the coolant circuit 37 although the coolant circuit 37 is not interrupted. This state is maintained even over the warm-up period of the internal combustion engine 38 at least until, after a predetermined coolant temperature has been reached, a controlled opening of the heating valve 57 causes a pressure drop between the cylinder bank 39 and the cylinder bank 40 leading to a coolant flow from the cooling space of the cylinder bank 39 through the discharge line 45, the mixing chamber 47, the discharge line 46 and through the cooling space of the cylinder bank 40 into the heating circuit 53. In this case, the cooling space of the cylinder bank 40 is used as part of the forward flow line 54.

The coolant flow acts here as a temperature control flow for the expansion element in the thermostatic valve 5".

With further heating, the expansion element in the thermostatic valve 5" opens the bypass opening, which is controlled by the short-circuit valve disk 51, so that coolant is conveyed in the short circuit between the supply line 42 and the discharge lines 45, 46. With increasing temperature of the coolant, the opening to the radiator line 48 is increasingly opened by the main valve disk 50, so that a mixture of cooled and uncooled coolant is fed to the cooling spaces. As soon as the coolant has reached a predetermined maximum coolant temperature, the bypass opening is closed and the connection to the radiator line is fully opened by the main valve disk 50.

What is claimed is:

1. A coolant circuit (37) for an internal combustion engine (38) having two cylinder banks (39, 40), a radiator (52) for cooling a coolant, a pump (41) for pumping the coolant and a thermostatic valve (5") including a mixing chamber (47) and first and second flow control valves (50, 51), said pump being connected to the radiator (32) via an intake line (42) for receiving coolant therefrom and pumping it to the cylinder banks (39, 40) via line strands (43, 44), said cylinder banks (39, 40) being in communication with the mixing chamber (47) via discharge lines (45, 46), a radiator line (48) extending from the mixing chamber (47) to the radiator (52) for returning coolant to the radiator under the control of a main flow control valve (50), a bypass line (49) extending from the mixing chamber (47) to the intake line (42) for bypassing the radiator (52) during engine warm-up under the control of a by-pass flow control valve (51), and a heating circuit (53, 54) including a heater (55) and extending from one of the cylinder banks (39, 40) to the pump intake line (42), said heating circuit (53, 54) including a heater control valve (57) for controlling the flow of coolant from said one of the cylinder banks (39, 40) to said pump supply line (42) so that, upon opening of the heater flow control valve (57), heated coolant flows not only from said one of the cylinder banks (39, 40) but also from the other of said cylinder banks (39, 40)) via the discharge lines (45, 46) and the mixing chamber (47) and also the one of the cylinder banks (39,40) through said heater (55) to said pump (41).

2. A coolant circuit for an internal combustion engine as claimed in claim 1, wherein, when the internal combustion engine (38) is operationally hot, the coolant flow through the heating circuit (53, 54) can be controlled or even blocked by the heating valve (57).

* * * * *